United States Patent [19]

Mayer et al.

[11] Patent Number: 4,601,180

[45] Date of Patent: Jul. 22, 1986

[54] LATCH NEEDLE FOR A TEXTILE MACHINE

[75] Inventors: Harald Mayer; Georg Wild, both of Albstadt, Fed. Rep. of Germany

[73] Assignee: Theodor Groz & Sohne & Ernst Beckert Nadelfabrik Commandit Gesellschaft, Albstadt-Ebingen, Fed. Rep. of Germany

[21] Appl. No.: 807,763

[22] Filed: Dec. 9, 1985

Related U.S. Application Data

[63] Continuation of Ser. No. 633,595, Jul. 23, 1984, abandoned.

[30] Foreign Application Priority Data

Aug. 27, 1983 [DE] Fed. Rep. of Germany ..... 3331031

[51] Int. Cl.[4] ..... D04B 35/04

[52] U.S. Cl. ..... 66/121

[58] Field of Search ..... 66/121, 122, 123, 124; 163/3, 5

[56] References Cited

U.S. PATENT DOCUMENTS

| | | | |
|---|---|---|---|
| 2,596,311 | 5/1952 | Vitoux | 66/121 X |
| 3,031,867 | 5/1962 | Wiederhut et al. | 66/121 |
| 4,294,086 | 10/1981 | Mayer et al. | 66/121 |

FOREIGN PATENT DOCUMENTS 2714607 10/1978 Fed. Rep. of Germany .

*Primary Examiner*—Wm. Carter Reynolds

*Attorney, Agent, or Firm*—Frishauf, Holtz, Goodman & Woodward

[57] ABSTRACT

To enable the latch (5) of a latch needle to be capable of absorbing great stresses without danger of damage to the needle latch, or to the needle itself, the latch has at least one through-aperture (11, 19) or opening in the region between its pivot bore (8) and the latch spoon (9).

12 Claims, 4 Drawing Figures

LATCH NEEDLE FOR A TEXTILE MACHINE

This application is a continuation of application Ser. No. 633,595, filed July 23, 1984, now abandoned.

The present invention relates to a latch needle for a knitting or textile machine, having a needle shank and a needle latch with a pivot bore which is supported in a longitudinal slot of the needle shank such as to pivot freely. In the closed position, the latch rests with its spoon on the needle hook, and in the open or rear position the latch spine rests on seating surfaces in the vicinity of the upper edge of the needle shank.

BACKGROUND

In high-speed textile machines, such as circular knitting machines, the needle latch is subjected to very great stresses. When the latch pivots between its closed position and its open or rear position with a frequency of up to 60 Hz and higher, as is usually the case at present, large forces of acceleration and deceleration arise at the needle latch. These forces not only stress needle latch by bending, but when the spoon strikes the hook or when the latch spine strikes the seating surfaces provided on the needle shank, considerably energies must be absorbed by resilient, elastic deformation and nullified by friction. As a consequence of these severe stresses, not only can the spoon and the hook be damaged, but the latch can also break, or damage can occur to the latch pivot and the needle shank.

It is known (U.S. Pat. No. 4,294,086, to which German Patent 27 14 607 corresponds) to dampen the impact of the needle latch in the rear position by means of a special arrangement of the longitudinal slot of the needle and thereby to avoid damage to the needle latch and the needle itself that might occur in the rear position of the latch. As a result of the cooperation between the needle shank side portions flanking the longitudinal slot of the needle and the wedge-shaped converging flanks of the seating surface on the latch spine, the side portions of the needle shank are spread apart elastically upon the impact of the needle latch, and at the same time friction is produced at the seating surfaces upon engagement with one another on the latch spine and the side portions of the needle shank. The overall result is that the needle latch is braked and damped. The elastic spreading of the needle shank side portions is limited, however, by the fact that the elasticity of the side portions of the shank decreases with increasing needle shank thickness.

Needles with pivoted blades, also known as Stelos point needles, are used for mending stockings or other knitted goods, see U.S. Pat. No. 2,596,311, Vitoux. In these needles, the forces of the pivoting blade acting on the hook are reduced by through- or penetrating holes or recesses, reduced thicknesses, or lightweight materials. In the Stelos point needles, the blade has a formed-on extension which is several times longer than the distance between the pivot and the hook, to project substantially beyond a nose which cooperates with the needle hook. Because this long extension end naturally places great stress on the needle latch, and in particular on that part of the latch which cooperates with the needle hook, it is formed with through-holes, or has an overall reduced wall thickness in comparison to the portion between the pivot and the hook, in order to reduce its weight. The blade of these Stelos point needles, which cannot be compared with standard knitting machine latch needles, is relatively massive and is not formed with a latch spoon.

THE INVENTION

It is an object of the present invention to devise a latch needle suitable particularly for high-speed knitting machines, in which the latch can absorb greater stresses than heretofore without the danger of damage to the needle latch or to other parts of the needle.

Briefly, the needle latch has at least one through opening in the area between its pivot bore and the spoon.

The inert mass of the needle latch is thereby decreased, so that the stress on the needle latch from the forces of acceleration and deceleration that occur is reduced and the impact energy when the spoon strikes the hook or the latch spine strikes the associated seating surfaces is reduced; further, the elastic flexing characteristics of the needle latch are simultaneously improved thereby, with the result that local peaks in stress that otherwise occur, particularly upon impact, are diminished. The latch needle is thus capable of absorbing the stresses arising over long periods in operation without the danger of damage to the needle latch or the latch pivot, even when used in very high-speed machines, such as circular knitting machines.

A form of embodiment which has provided to be very advantageous is one in which the through hole has a slit-like, elongated form; it may be wider in the vicinity of the bearing bore than in the vicinity of the spoon, so as to provide for adaptation to the somewhat wedge-shaped cross-sectional the needle latch. In another form of embodiment, the latch may also have a number of openings, e.g. circular holes located in a row and spaced from each other. It is suitable for the opening or openings to be disposed symmetrically with respect to the central longitudinal plane of the needle latch containing the bearing bore axis.

DRAWINGS

DETAILED DESCRIPTION

Figure 1:
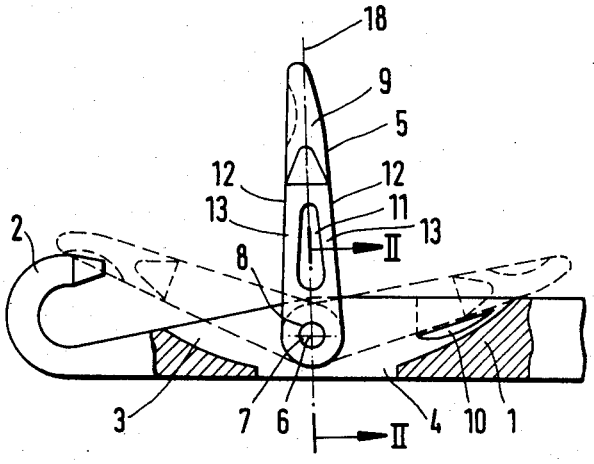
FIG. 1 is a fragmentary side view, partially in an axial section, of a latch needle according to the invention.

The latch needle shown in various forms of embodiment in the drawings has a needle shank 1 with a needle hook 2 disposed on its end. A longitudinal slot 3 is disposed in the needle shank 1 and is provided with a slit or aperture 4 leading to the lower edge of the needle shank, and a needle latch 5 is supported in the longitudinal slot 3 such that it pivots freely, i.e. undamped about a latch pivot 6. The latch pivot 6 is formed by two bearing tangs 7 extending out of the side portions laterally defining the longitudinal slot 3. The needle latch 5 is supported on the bearing tang 7 by means of a pivot bore 8. The needle latch 5 has a spoon 9 on one end. The spoon 9 just overlaps the tip of the needle hook 2 when it is in its closed position. In the rear or open position, it rests with seating surfaces, embodied on wedge-shaped convergent flanks of its spine, on seating surfaces 10 adapted to the shape of its spine which are located in the region of the upper edge of the side faces of the needle shank 1 defining the longitudinal slot 3. The rear position and the closed position of the needle latch are shown in dashed lines in FIGS. 1 and 3, respectively.

Figure 2:
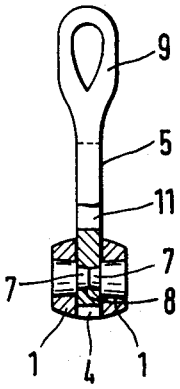
FIG. 2 is a side view of the latch needle of FIG. 1, in a section taken on the line II—II of FIG. 1.

In accordance with the invention, the latch 5, in the region between the pivot bore 8 and the spool 9, is provided with at least one through opening, or hole, in all the forms of embodiment shown:

In the form of embodiment shown in FIGS. 1, 2, a through hole 11 of elongated, slit-like shape is provided in the needle latch 5 in the region shown. In the vicinity of the pivot bore 8, this recess 11 is wider than in the vicinity of the spoon 9, and with the adjacent side faces 12 of the needle latch 5, which in side view is somewhat wedge-shaped, it therefore defines thin ribs 13, which are joined to one another at the end by the material comprising the needle latch 5 and in turn effect a connection between the portion of the needle latch 5 containing the pivot bore 8 and the spoon 9 thereof.

The elongated opening, or recess, 11 not only effects a reduction of the inert mass of the needle latch 5 but also results in a favorably dynamic flexing behavior on the part of the needle latch.

Figure 3:
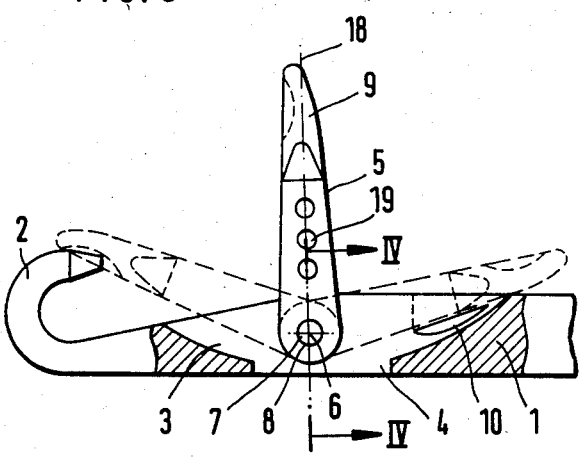
FIG. 3 shows a latch needle according to the invention in a view corresponding to FIG. 1 but of another form of embodiment.
Figure 4:
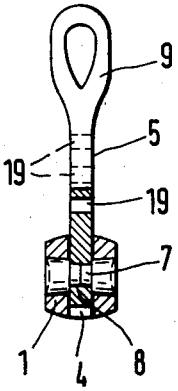
FIG. 4 is a side view of the latch needle of FIG. 3, in a section taken on the line IV—IV of FIG. 3.

The form of embodiment shown in FIGS. 3, 4 corresponds substantially to that of FIGS. 1, 2. Identical elements are therefore provided with the same reference numerals and need no further description.

In this form of embodiment of FIGS. 3, 4, the needle latch 5 is provided with a number of circular holes or apertures 19 in the region between the pivot bore 8 and the spoon 9. These apertures 19 are formed as cylindrical holes and are disposed spaced apart from one another in a row, with their axes located in the plane 18 containing the latch pivot 6. The circular holes 19 may have identical diameters, or else their diameters may become progressively smaller from the pivot bore 8 toward the spoon 9. Instead of the cross-sectional shape shown here, the holes 19 may also have a different shape, for instance oblong. It is also possible for them to be disposed not in one row, with their axes located in the common plane 18, but rather distributed over the associated side surfaces of the needle latch 5.

We claim:

1. High speed knitting machine latch needle having a needle shank (1) formed with a hook (2) at one end portion thereof and with a latch seating surfaces (10)

a needle latch (5) formed with a pivot bore (8) at one end portion thereof and pivotably retained on the shank (1), the latch being formed with a needle spoon (9) at the end remote from the bore (8) for engagement with the hook (2) when the needle latch is pivoted into closed position, the back of the spoon (9) of the latch having seating surfaces engaging the latch seat surfaces (10) on the shank when the needle latch is pivoted to open position, and comprising an arrangement to increase the elasticity of the needle latch (5) in the region between the seating surfaces on the back of the spoon (9) and the pivot bore, and to reduce the impact force between the needle latch and the needle shank as the latch is pivoted between open and closed positions which includes at least one through-opening (11, 19) formed in the latch in the region between the spoon (9) and the pivot bore (8).

2. Latch needle according to claim 1, wherein the opening (11) has a slit-like, elongated shape.

3. Latch needle according to claim 2, wherein the slit-like opening (11) is wider in the vicinity of the pivot bore (8) than in the vicinity of the spoon (9).

4. Latch needle according to claim 1, wherein the opening comprises at least one essentially circular hole (19).

5. Latch needle according to claim 4, wherein a plurality of circular holes (19) are provided, positioned spaced apart from each other.

6. Latch needle according to claim 1, wherein the opening (11) is disposed symmetrically with respect to the central longitudinal plane (18) of the needle latch (5) passing through the latch pivot (6).

7. For combination with a high speed circular knitting machine, a latch needle having a needle shank (1) formed with a hook (2) at one end portion thereof and with a latch seating surfaces (10)

a needle latch (5) formed with a pivot bore (8) at one end portion thereof and pivotably retained on the shank (1), the latch being formed with a needle spoon (9) at the end remote from the bore (8) for engagement with the hook (2) when the needle latch is pivoted into closed position, the back of the spoon (9) of the latch having seating surfaces engaging the latch seat surfaces (10) on the shank when the needle latch is pivoted to open position, and comprising an arrangement to increase the elasticity of the needle latch (5) in the region between the seating surfaces on the back of the spoon (9) and the pivot bore, and to reduce the impact force between the needle latch and the needle shank as the latch is pivoted between open and closed positions which includes at least one through-opening (11, 19) formed in the latch in the region between the spoon (9) and the pivot bore (8).

8. Latch needle according to claim 7, wherein the opening (11) has a slit-like, elongated shape.

9. Latch needle according to claim 8, wherein the slit-like opening (11) is wider in the vicinity of the pivot bore (8) than in the vicinity of the spoon (9).

10. Latch needle according to claim 7, wherein the opening comprises at least one essentially circular hole (19).

11. Latch needle according to claim 10, wherein a plurality of circular holes are provided, positioned spaced apart from each other.

12. Latch needle according to claim 7, wherein the opening (11) is disposed symmetrically with respect to the central longitudinal plane (18) of the needle latch (5) containing the latch pivot (6).

* * * * *